US007874032B2

(12) United States Patent
North et al.

(10) Patent No.: US 7,874,032 B2
(45) Date of Patent: Jan. 25, 2011

(54) METHOD AND DEVICE FOR MAINTAINING A SIDE SLEEPING POSITION

(76) Inventors: Vaughn North, 7431 Lost Canyon Cir., Salt Lake City, UT (US) 84121; Myrna North, 7431 Lost Canyon Cir., Salt Lake City, UT (US) 84121

( * ) Notice: Subject to any disclaimer, the term of this patent is extended or adjusted under 35 U.S.C. 154(b) by 0 days.

(21) Appl. No.: 12/490,143

(22) Filed: Jun. 23, 2009

(65) Prior Publication Data

US 2009/0313761 A1 Dec. 24, 2009

Related U.S. Application Data

(60) Provisional application No. 61/075,286, filed on Jun. 24, 2008.

(51) Int. Cl.
*A47C 20/00* (2006.01)
*A47C 20/08* (2006.01)
*A47G 9/10* (2006.01)

(52) U.S. Cl. ..... 5/632; 5/630; 5/657; 5/652

(58) Field of Classification Search ..... 5/632, 5/630, 631, 652, 655, 657, 930
See application file for complete search history.

(56) References Cited

U.S. PATENT DOCUMENTS 2,562,725 A * 7/1951 Leto et al. ..... 5/631
2,629,884 A * 2/1953 McMonagle ..... 5/655
2,765,480 A * 10/1956 Mueller ..... 5/640
2,952,856 A * 9/1960 Ruff ..... 5/640
3,924,282 A 12/1975 Bond
4,274,673 A * 6/1981 Kifferstein ..... 297/220
4,506,396 A * 3/1985 Ritchie et al. ..... 5/631
4,528,981 A * 7/1985 Behar ..... 5/637
4,744,117 A 5/1988 Bond
5,040,546 A 8/1991 Deluhery
5,044,026 A * 9/1991 Matthews ..... 5/644
5,165,130 A * 11/1992 Wendling ..... 5/655
5,182,828 A 2/1993 Alivizatos
5,189,748 A * 3/1993 Garrison et al. ..... 5/655
5,193,238 A * 3/1993 Clute ..... 5/655
5,216,772 A * 6/1993 Clute ..... 5/655
5,272,780 A * 12/1993 Clute ..... 5/655
5,289,748 A 3/1994 Kuchta et al.

(Continued)

*Primary Examiner*—Robert G Santos
(74) *Attorney, Agent, or Firm*—Thorpe North & Western LLP

(57) ABSTRACT

A method and device for developing a positional orientation sleep aspect (POSA) to enable an individual to assume at least one preselected side-sleeping orientation on either a left or right side, including the steps of: a) placing first and second cylindrically configured, elongate pillows in parallel orientation on the bed, tethered by an intermediate member having a length approximately equal to a distance from the individual's low back to an extended knee; b) positioning the individual's body in a preselected, side-position on the intermediate member, c) establishing two additional, concurrent points of contact respectively at the individual's low back side with the first pillow and a projecting limb or knee with the second pillow; and d) sustaining the at least three points of contact to establish a sustainable recognition and awareness during sleep of the side-position while allowing the individual freedom of movement to also assume alternate right and left side positions, including free movement of the limbs between the pillows.

20 Claims, 15 Drawing Sheets

U.S. PATENT DOCUMENTS 5,310,245 A * 5/1994 Lyszczasz ..... 297/219.12
5,341,531 A * 8/1994 Straub et al. ..... 5/655
5,347,669 A * 9/1994 Neviaser et al. ..... 5/655
5,359,739 A 11/1994 Rains et al.
5,367,730 A * 11/1994 Sher ..... 5/655
5,499,418 A * 3/1996 Tan et al. ..... 5/655
5,522,104 A 6/1996 Little
5,530,974 A 7/1996 Rains et al.
5,535,467 A * 7/1996 Ciske ..... 5/636
5,581,832 A * 12/1996 Bridley ..... 5/655
5,754,998 A * 5/1998 Selton ..... 5/652
5,910,080 A * 6/1999 Selton ..... 5/652
6,009,873 A * 1/2000 Neviaser ..... 128/845
6,067,679 A * 5/2000 Rice ..... 5/630
6,081,950 A * 7/2000 Selton ..... 5/652
6,381,787 B1 * 5/2002 Rogone et al. ..... 5/655
6,560,800 B1 * 5/2003 Draves ..... 5/630
6,640,366 B1 * 11/2003 Draves ..... 5/630
6,698,432 B2 3/2004 Ek
6,877,176 B2 * 4/2005 Houghteling ..... 5/655
6,886,201 B1 * 5/2005 Weiss-Lohrei ..... 5/631
6,954,954 B2 * 10/2005 Stelnicki ..... 5/655
6,971,715 B2 * 12/2005 Hankins ..... 297/219.11
7,117,553 B2 * 10/2006 Fairchild et al. ..... 5/655
7,360,265 B2 * 4/2008 Lamer ..... 5/655
2009/0229054 A1 * 9/2009 Yates et al. ..... 5/490
2009/0229618 A1 * 9/2009 Sotelo et al. ..... 128/848
2009/0313760 A1 * 12/2009 Blake et al. ..... 5/632
2009/0313761 A1 * 12/2009 North et al. ..... 5/632
2010/0088824 A1 * 4/2010 Tanner ..... 5/655

* cited by examiner

METHOD AND DEVICE FOR MAINTAINING A SIDE SLEEPING POSITION

This application claims the benefit of U.S. Provisional patent application Ser. No. 61/075,286 filed Jun. 24, 2008, which is incorporated by reference in its entirety herein.

BACKGROUND OF THE INVENTION

1. Field of the Invention

The present invention relates generally to a method for assisting a person to regulate sleeping positions during a semi-conscious or unconscious state, such as to remain on a side while sleeping and thereby avoid sleeping in a supine position.

2. Related Art

Sleep positional orientation may be an important factor for many persons in preserving health. For example, the typical dominant period of healing for the human body occurs during sleep. Similarly, periods of illness or recovery often require additional rest that involves extended bedtime and sleep. During times of sleep, semi-consciousness or unconsciousness, the position of the body is seldom within the person's conscious awareness. One may be changing positions among basic orientations of lying on one's back, left side, right side, and front. In addition, there are transitional positions between each of these basic positions (partially on back and left side, etc) that further define a near continuum of position orientations for the human body while in a bed-rest condition.

It is recognized that certain body positions may be preferred or even required during sleep and rest for effective health recovery and/or health maintenance. For example, persons having sleep apnea may be more vulnerable to stop breathing and disruption of sleep when lying in a back or supine orientation, as compared to sleeping on a side. Similarly, individuals with a snoring problem may be less inclined to snore when in a side-sleeping position. In addition, relative physical positioning of parts of the body may be important, such as when one has a shoulder injury, spine misalignment, hip problem, etc. Even the process of aging may be improved by disposing the body in particular sleep or rest orientations that avoid stressing certain muscle groups and skeletal relationships. In short, a system or methodology of facilitating and controlling a more healthy positional orientation during sleep or rest would be beneficial.

SUMMARY OF THE INVENTION

The present invention is a method for developing a positional orientation sleep aspect (POSA) to enhance individual awareness of sleeping position to enable the individual located on a bed of fixed width to assume at least one preselected side-sleeping orientation on either a left or right side. The method utilizes a pillow combination having a full transverse span shorter than the fixed width of the bed and including first and second elongate pillows tethered together in parallel orientation by an intermediate member for providing concurrent support at front and back sides of the individual. Specific steps of the invention include:

a) placing the tethered pillows on the bed with the tethered pillows in the parallel orientation;

b) positioning the individual's body in a preselected, side-position orientation on the intermediate member to capture the intermediate member under a trunk portion of the body while establishing at least three separate and concurrent points of contact including (i) contact of the trunk portion in the side-position orientation with the intermediate member on the bed, (ii) contact of a back side of the trunk portion with an adjacent side of the first pillow, and (iii) contact of a forward projecting limb from the trunk portion with the second pillow; and c) sustaining the at least three points of contact over a sufficient period of time prior to and during sleep to establish a sustainable recognition and awareness to the individual during sleep of the side-position orientation (referred to as POSA) while allowing the individual freedom of movement to also assume alternate positions between the pillow combination, including free movement of the limbs.

The invention is also represented by a device for developing a positional orientation sleep aspect (POSA) to enhance individual awareness of sleeping position to enable the individual located on a bed of fixed width to assume at least one preselected side-sleeping orientation on either a left or right side. The device comprises:

a) a pillow combination having a full transverse span extending to a maximum length between fully extended outer edges of the first and second pillows, which maximum length is shorter than the fixed width of the bed, and including first and second elongate pillows tethered together in parallel orientation by an intermediate member and configured to provide concurrent, juxtaposed support at front and back sides of the individual disposed there between, said first and second elongate pillows having a separation distance corresponding to a width of the intermediate member which is approximately equal to and no greater than a length extending (i) from a low back portion of hips (ii) to a forward portion of knees of the individual;

b) said pillow combination being configured for positioning the individual's body in a preselected, side-position orientation on the intermediate member to capture the intermediate member under a trunk portion of the body while establishing at least three separate and concurrent points of contact including (i) contact of the trunk portion in the side-position orientation on the intermediate member, (ii) contact of a back side of the trunk portion of the individual with an adjacent side of the first pillow, and (iii) contact of a forward projecting limb of the individual from the trunk portion with the second pillow.

A further invention includes a method for assisting an individual to maintain at least one preselected side-sleeping orientation on either a left or right side on a bed of fixed width, said method utilizing a pillow combination having a full transverse span from outer side edge to outer side edge of the pillow combination which is shorter in length than the fixed width of the bed and including first and second elongate pillows tethered together in parallel orientation by an intermediate member for providing concurrent support at forward and back sides of the individual. As used herein, reference to forward side would include the front side of the trunk and the space forward of the trunk, such as extending along the arms and legs in a forward orientation. The method comprises the steps of:

a) placing the pillow combination on the bed;

b) positioning the individual on the intermediate member to capture the intermediate member under the individual with the individual's hips and lower back positioned between the first and second pillows;

c) positioning the first pillow in a support position at the individual's lower back in a manner that restrains the individual from rolling onto his back;

d) positioning the second pillow in a movable configuration between (i) a distended position with the intermediate member extended to the full transverse span and (ii) a retracted position with the second pillow in closer proximity with the forward side of the individual;

e) selecting a sleep position for the individual having at least three separate and concurrent points of contact including (i) contact of the individual in the side-position orientation with the intermediate member on the bed, (ii) contact of the individual's lower back in the support position with the first pillow, and (iii) contact of a forward projecting limb of the individual with the second pillow; and f) sustaining the at least three points of contact over a sufficient period of time prior to and during sleep to establish a sustainable recognition and awareness to the individual during sleep of a positional orientation sleep aspect representing the side-position orientation while allowing the individual freedom of movement to also assume alternate positions between the pillow combination, including free movement of the limbs.

EMBODIMENTS OF THE INVENTION

Figure 1:
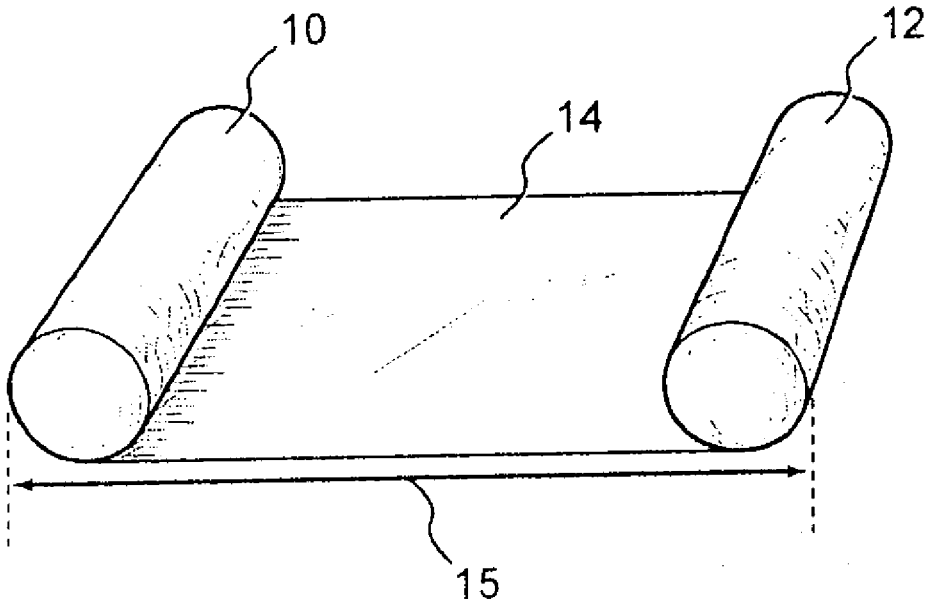
FIG. 1 illustrates a perspective view of the present invention showing opposing pillows tethered to an intermediate member.

Under normal circumstances, a person moves through various sleeping positions (right or left side and back or front) in a random manner. This mobility is an important factor for a healthy sleep experience. It is generally undesirable, therefore, to limit the body to one sleeping position such as may occur by simply imposing pillows at front and back sides of the individual in a restraining manner. Although positioning a pillow at a single side of an individual can initially place the individual in a preferred side position, once the body moves away from the pillow, its positioning value is substantially compromised. Positional Orientation Sleep Aspect (POSA) is a methodology and system which helps a person attain desired side sleeping positions without excessive restriction of movement. As used in this application, reference to "side" will usually refer to a lateral portion of the individual's trunk, as opposed to the front and back of the individual, References to "front side" or "back side" should be understood to mean the front and back of the individual, as opposed to the lateral sides corresponding to the location of the arms.

A typical sleeping environment is a bed 20 (FIG. 2) or other substantially flat surface which supports the body of the individual in a generally horizontal plane. In this sense, the contact surface of the bed is one-dimensional in that the individual's body has a single side of contact—be it the front, back or opposing sides. This one-dimensional contact is acceptable during periods of being awake because the individual can simply make a mental decision to remain in the side-sleeping orientation. Being alert prior to sleep, the individual simply chooses his body position. As he falls into a state of sleep, however, he typically looses this sense of awareness. In a semi or subconscious state, the individual typically moves about without this mental awareness and is not able therefore to control a positional preference. Apparently, the brain does not naturally monitor position orientation in the state of sleep, at least to the extent that a preference for sleeping position is controlled to any certain degree.

Over time, an individual may acclimate to various position tendencies, such as sleeping on one's side or back, and these tendencies may even become somewhat habitual. Unfortunately, however, those individuals having an habitual tendency to sleep on their back may find themselves more prone to snoring or other breathing problems such as sleep apnea. In these situations, the need to shift from sleeping on one's back to a side-sleeping orientation has been very difficult to achieve. Strategies have usually involved physically forcing the individual to assume the desired position, Specifically, the use of restraining pillows and devices compressed against the body that thereby block movement have often been required. Some sleep apnea patients have been encouraged to place a tennis ball or other hard object on their back, to discourage a supine position; however, this method is both uncomfortable and physiologically problematic. For example, the weight of the object resting against the person's back in a side orientation may be distracting and annoying.

The present invention provides a method for enabling an individual to mentally sustain an inclination for a desired sleeping position rather than being physically forced to do so. Applying this invention to a sleep environment allows the person to move through a variety of positions with substantial freedom of movement, yet maintain a preference for the desired side-sleeping orientation. This is accomplished by developing a frame of reference for the mind and body based on a positional orientation sleep aspect (POSA). This is accomplished by providing a three-dimensional frame of reference to the body through appropriate contact points in a three-dimensional domain. Specifically, by establishing and maintaining at least two respective contact points at the forward and back sides of the individual, in addition to a third point of contact of the person on the bed surface, an increased mental awareness of the body's orientation can be sustained, despite the unconscious state of the individual during sleep. Case studies applying POSA to medical patients have demonstrated that this awareness appears to operate even while moving through various changing positions, ultimately returning the individual to a desired side-sleeping orientation.

The first point of reference in the POSA is contact of the trunk portion of the individual in the side-position orientation on the bed as shown in the figures. This naturally occurs based on the body being on the bed surface. Normally, this contact would extend along the length of the person, such as from the head, through the trunk and legs, down to the feet. This is referred to as a single point of contact, however, because in the frame of reference, it constitutes a single side of the individual. In the present invention, a primary interest is to establish either the right or left side of the individual as the first point of contact. In other words, the first point of reference is contact of the body in the side-position orientation on the bed. Because the present invention uses a pillow combination (FIGS. 1 and 2) comprising opposing first and second pillows 10 and 12 tethered between an intermediate member 14 positioned on the bed 20, the actual contact of the individual includes contact of a trunk portion 13 of the body with the intermediate member 14 on the bed.

A second point of reference is contact of a back side of the trunk portion with an adjacent side of the first pillow 10. This contact may be at the shoulders or hips, and any point there between. The nature of the contact arises from the stiffness and size of the pillow. The pillow needs to be sufficiently stiff to resist the weight of the body against it, yet soft enough to be comfortable to body contact.

It is desired that the pillow be sufficiently large in diameter to impede movement of the body over the pillow. Typically, at least a three inch diameter is desired; however, users have discovered that larger diameter pillows can be used as needed. Individual preference is typically determined by balancing the minimal size needed to restrain movement of the user with the maximum size that can be managed conveniently for (i) placement, (ii) maneuvering the individual to and from the pillow combination, and (iii) convenient storage of the device. A variety of sizes will be practical, when considering these minimum and maximum size considerations for different sized individuals.

The pillow also needs to be sufficiently stiff and resilient such that it does not compress under weight of the body and can thereby support and resist the second contact point of the POSA. Various pillow materials are available to meet this requirement. The inventors have found that materials selected from the group of comparable materials represented by inflatable bladders, tubular members with resilient filler such as foam, resilient tubular members, resilient tubular members with air flow channels and elongate cushions are suitable. Inflatable bladders include inflated air pillows coupled to opposing sides of the intermediate member. These offer the advantage of adjustable stiffness, based on a variable degree of inflation of each pillow. They are also light in weight and do not bear against the body in the manner that a heavier pillow will do. This light-weight comfort of the inflatable pillow may be a significant factor for persons that are sensitive to objects against their body.

A further advantage of the inflated pillow is dissipation of body heat that is captured at the contact point of the pillow with the individual's back. An inflated pillow allows transfer of body heat to air within the pillow and typically provides a more comfortable temperature environment for the user. In contrast, foam pillows, down inserts and other highly insulative materials can trap body heat and cause a person to sweat during the night. Finally, the air bladder offers the advantage of deflation. Specifically, it can be deflated for transport or storage and therefore offers the benefit of a smaller shipping or storage space.

Figure 9:
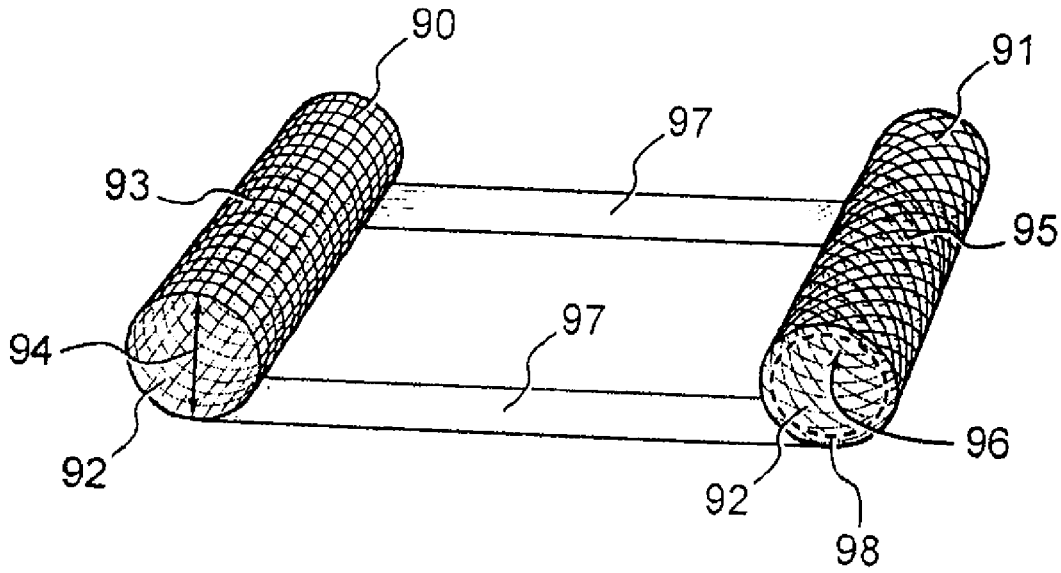
FIG. 9 illustrates an alternate embodiment of the pillow system.

Other tubular members with resilient filler can be used as the pillow component of the system. These materials may be of foamed rubber or plastic, flowable beads, fluids, down and other conventional pillow insert material, etc. Tubular sections of the pillow combination may be formed and filler material inserted therein either on a permanent basis during manufacture or by the user at his preference. Tubular members formed of resilient plastic as illustrated in FIG. 9 can also be used such as plastic mesh, and can provide temperature relief with air flow through the lumen of the tube as well as the tube wall. Other materials and combinations will be recognized by those skilled in the art in view of the present invention disclosure.

A third contact reference point for the POSA includes contact of a forward projecting limb (arm or leg) of the individual with the second pillow 12. This contact may be with the knee or elbow in a restraining configuration with the opposing pillows at maximum separation based on forceful resistance supplied by the fixed length of the thigh or upper arm, or a relaxed contact with less force between the second pillow and a lower leg or foot, and/or forearm or hand. Illustrative contact configurations are provided in the following disclosure.

Additional points of contact may be useful, such as contact of both an arm and/or hand and leg and/or foot. Accordingly, at least a fourth point of contact can be applied as part of the POSA system, using an additional contact between an additional forward projecting limb of the user with the second pillow. Other variations of contact will also be apparent to those skilled in the art, based on the disclosed invention.

The POSA system can be implemented to enable the individual located on a bed of fixed width to assume at least one preselected side-sleeping orientation on either a left or right side, The method utilizes a pillow combination having a full transverse span 15 shorter than the fixed width of the bed 17 and including the first and second elongate pillows 10 and 12 tethered together in parallel orientation by an intermediate member 14 for providing concurrent support at front and back sides of the individual. The intermediate member can be formed of any flexible material that is suitable in a sleep environment. Typically, a sheet material comparable to bed sheets is appropriate; however, plastic sheets having a comfortable surface covering could be used, particularly in combination with inflatable bladders which are integrally formed at opposing edges of the intermediate member where plastic is required as an inflatable component.

An example of one method for applying the POSA concept to an individual is represented by the following steps:

a) placing the tethered pillows 10 and 12 on the bed with the tethered pillows in the parallel orientation;

b) positioning the individual's body in a preselected, side-position orientation on the intermediate member 14 to capture the intermediate member under a trunk portion of the body while establishing at least three separate and concurrent points of contact points as described above;

c) sustaining the at least three points of contact over a sufficient period of time prior to and during sleep to establish a sustainable mental recognition and awareness to the individual during sleep of the side-position orientation while allowing the individual freedom of movement to also assume alternate positions between the pillow combination, including free movement of the limbs (arms and legs). Because the user is lying on the attached intermediate member, the pillow positioned at his back is prevented from rolling away from the individual, enabling it to resist the user's effort to roll onto his back during sleep.

Figure 2:
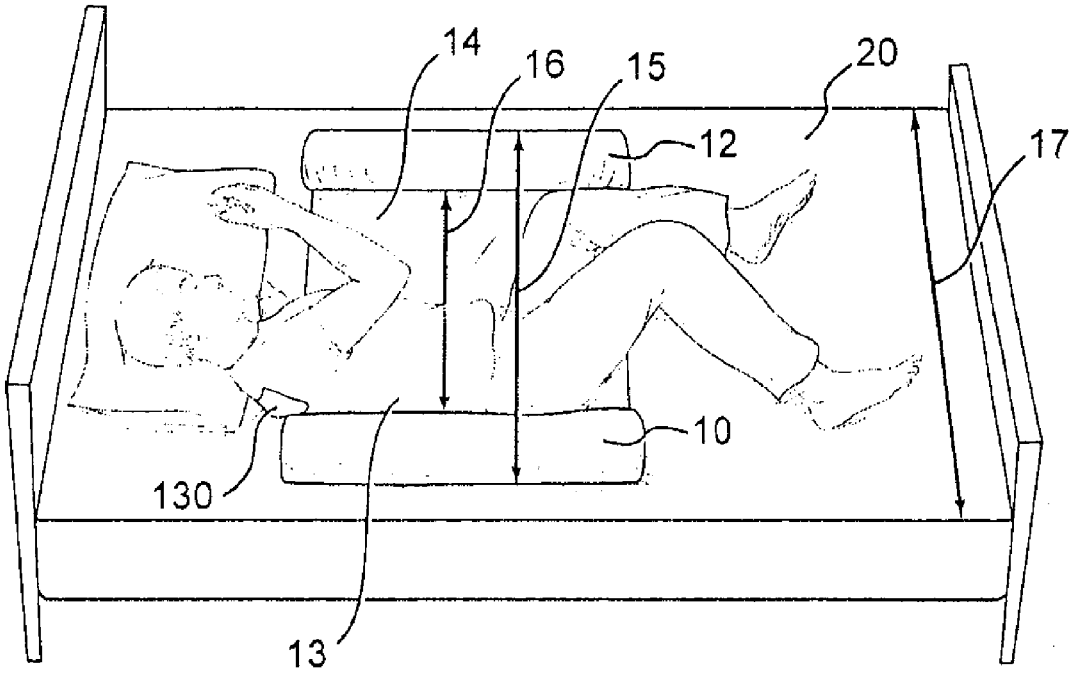
FIG. 2 depicts a graphic, perspective view of the invention in use on a bed with the pillow system fully extended.
Figure 3:
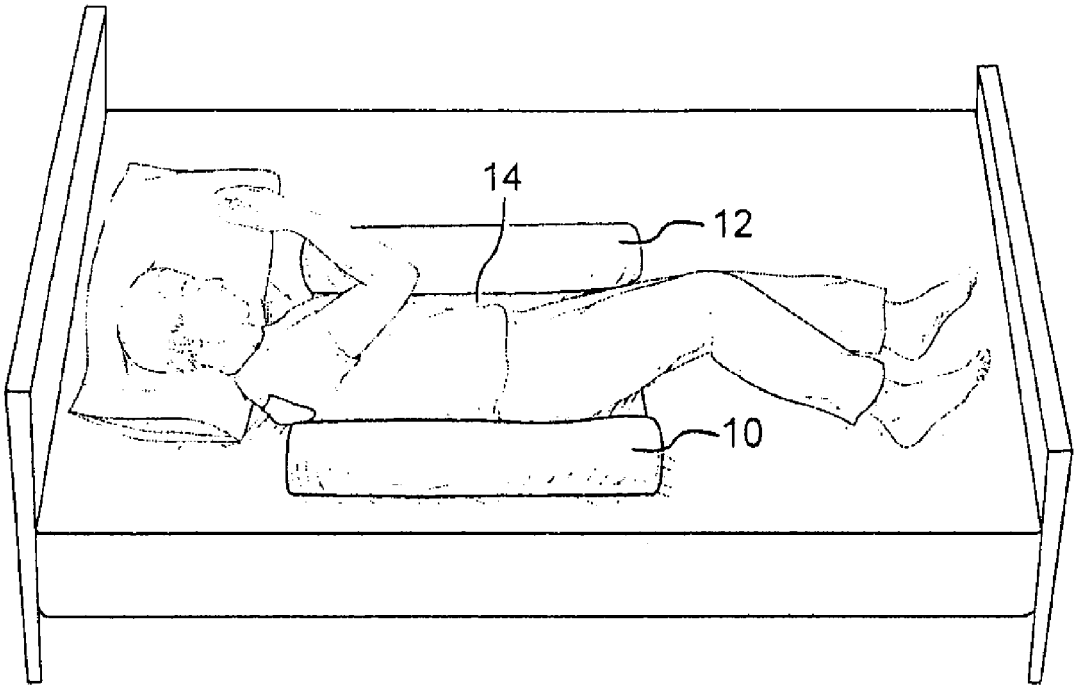
FIG. 3 shows an alternate sleeping position with the present invention with the system fully retracted to the user's body.

A specific example of this method is represented by the following steps:

a) placing the tethered pillows 10 and 12 on a sleep surface 20;

b) positioning the individual on the intermediate member 14 to capture the intermediate member under the individual with the individual's hips and low back positioned between the first and second pillows;

c) positioning the first pillow 10 in a support position at the individual's lower back as shown in the figures in a manner that restrains the individual from rolling onto his back;

d) positioning the second pillow 12 in a movable configuration between (i) a distended position [FIG. 2] with the intermediate member extended to full length 16 and (ii) a retracted position [FIG. 3] with the second pillow in direct contact with the forward side of the individual and in contact with at least one limb of the individual;

e) shifting location of the second pillow to an alternate adjusted position while maintaining forward and back contact with the second and first pillows respectively, within the range of positions as defined in step d) with the individual in a side-sleeping orientation prior to and during sleeping to establish the desire mental awareness of the contact points and side sleeping position.

Figure 5:
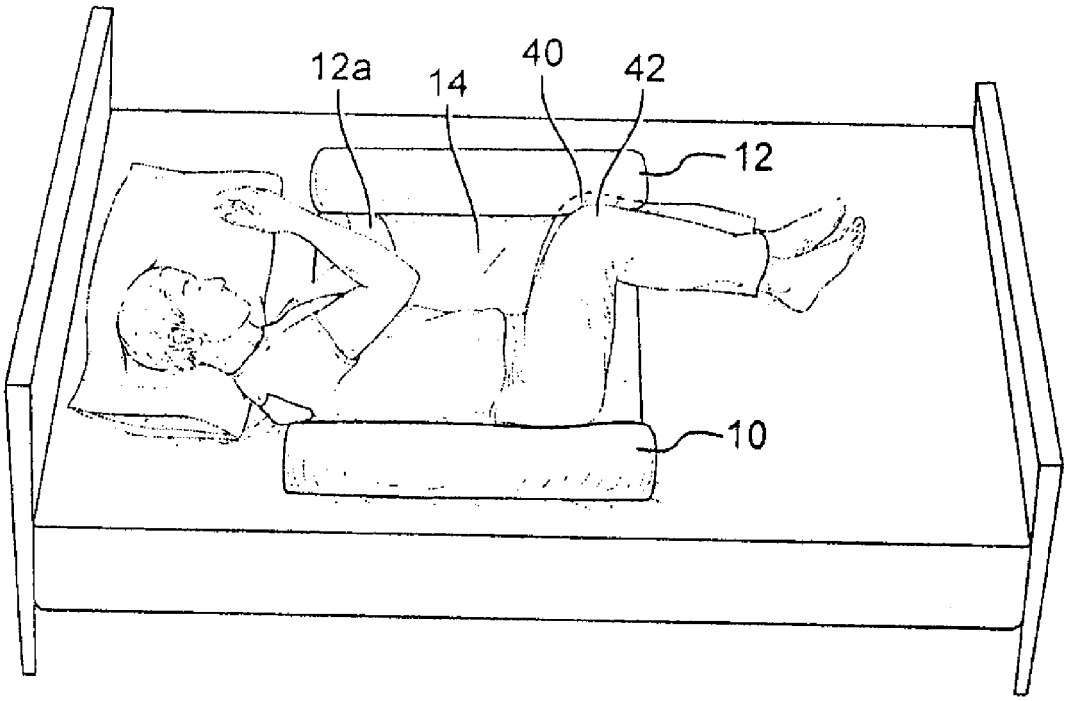
FIG. 5 depicts the pillow in partial extension, captured at the user's knees.

FIGS. 2 and 5 illustrate a method for developing a positional orientation sleep aspect as previously described, further comprising the step of configuring the pillow combination with the intermediate member length 16 approximately equal to a distance extending from the low back of the individual's body to knees of the individual. An ideal position exists when the knees of the individual are in slight tension with the second pillow, while the individual's back is in contact with the first pillow. FIG. 2 shows such a position with one knee engaging the second pillow, allowing free movement of the other leg, while FIG. 5 illustrates both legs at right angle with the trunk and in contact with the second pillow.

Because the pillows are tethered together by the intermediate member, the distended position of FIG. 2 represents an extreme position of separation. This separation distance 16 typically will usually be the length extending from the low back side of the user to his knees, particularly with the knees raised to a perpendicular orientation with his body. In this position, the knees push against the second pillow and prevent forward movement of the user, so that he remains biased against the first pillow located on his low back. Although this confining position stabilizes the user against movement to his back, such confinement may be uncomfortable for extended periods of time. Accordingly, multiple orientations are encouraged in the POSA concept, with movement being an important part of natural sleep activity.

Figure 6:
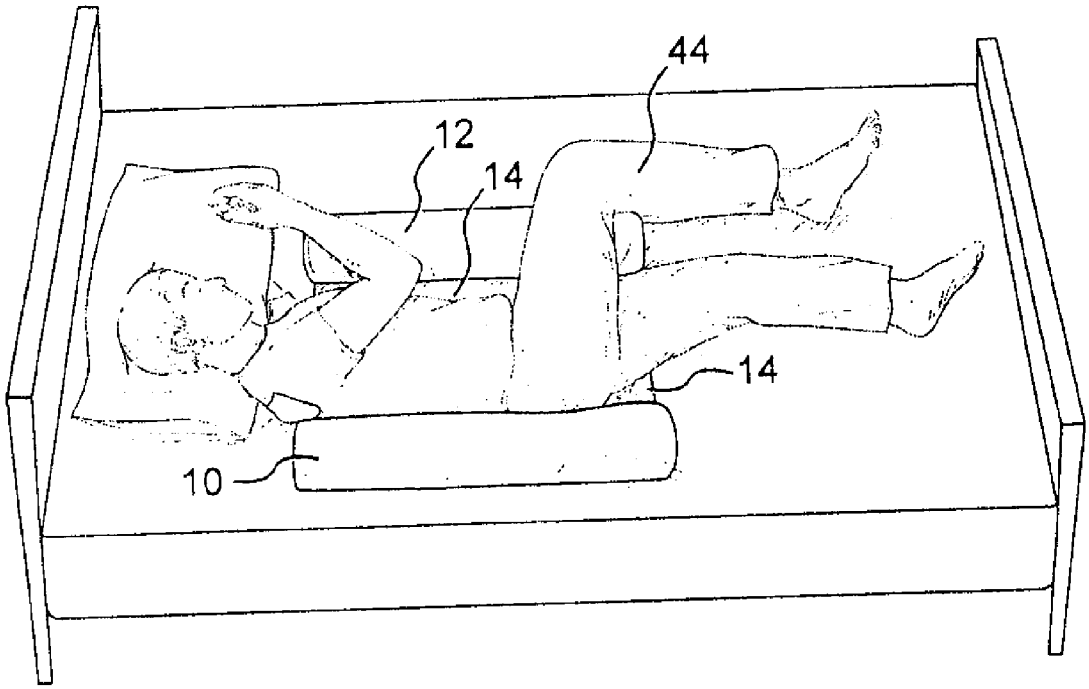
FIG. 6 illustrates the pillow partially extended, with the user's right leg draped over the pillow.
Figure 7:
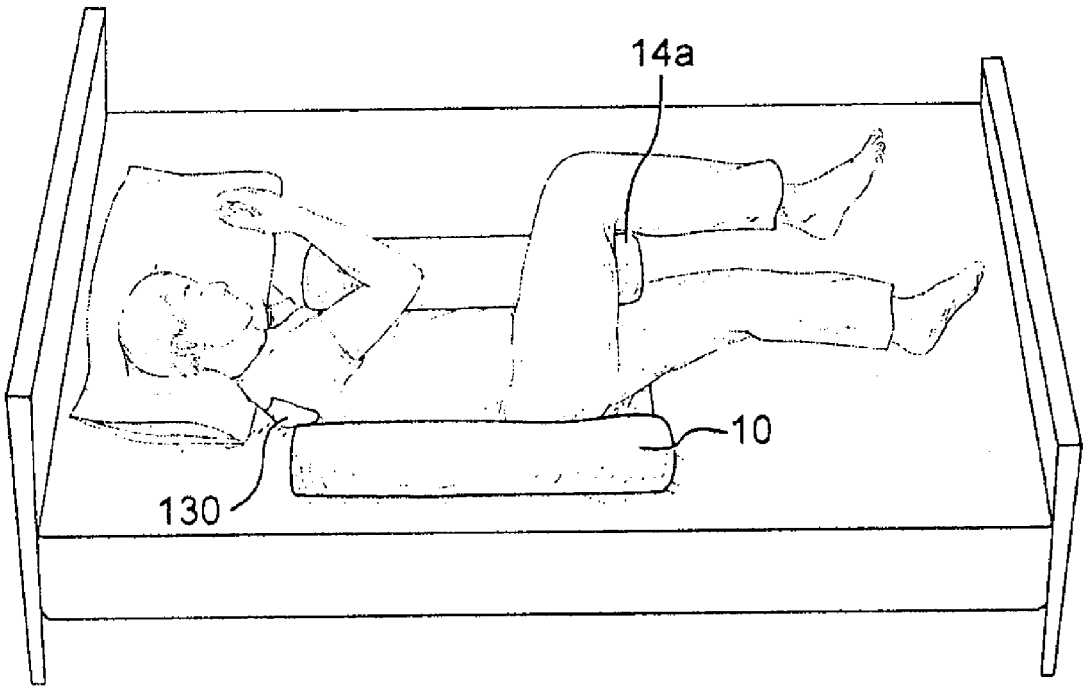
FIG. 7 shows the pillow in a retracted position against the user, with the right leg extended over the pillow and the left leg partially captured under the pillow.
Figure 8:
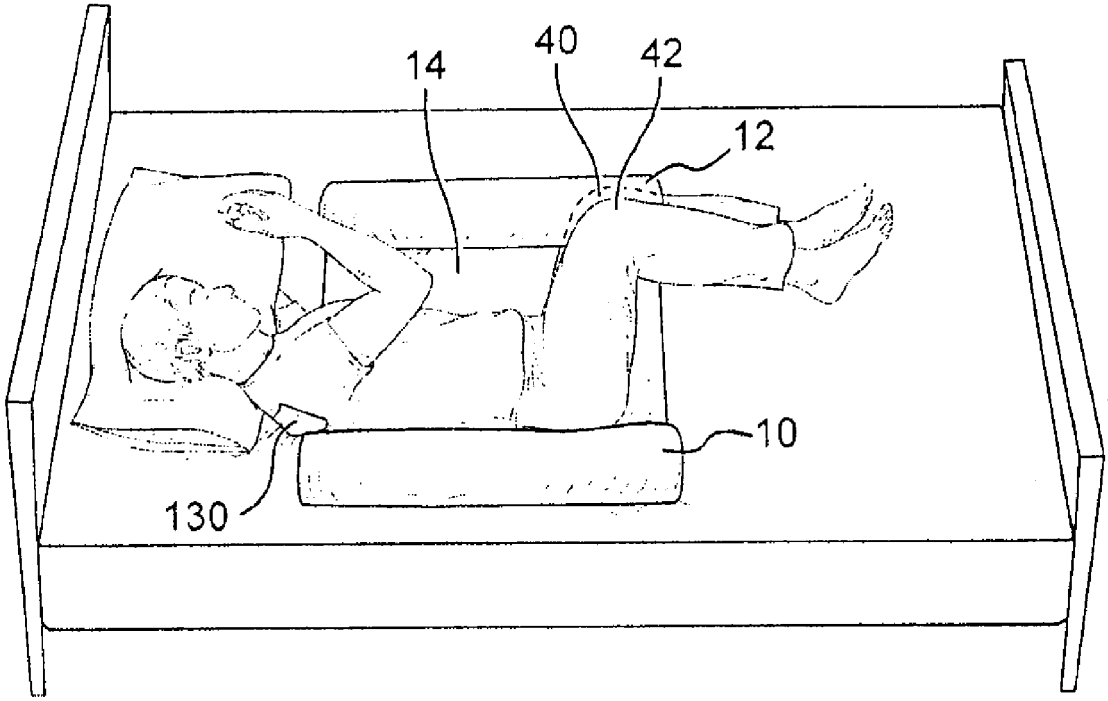
FIG. 8 depicts a partially extended pillow configuration with the pillow captured between the user's knees.

In contrast with prior methods of stabilizing the user with fixed pillows at both sides of his trunk, the present invention enables free movement of the user on a controlled basis. When the user feels the need to shift positions, he can release tension on the second pillow by lowering his knees, and then immediately rolling the second pillow towards his body to an intermediate position as shown in FIG. 6, 7 or 8, or to an opposing extreme position in which the second pillow is captured in contact with his abdomen and/or legs as shown in FIG. 3. In this new position, the user is again restrained from moving to his back. In the fully retracted configuration, the second pillow is rolled into full frontal contact with the abdomen of the user. This is easily accomplished by simply rolling the second pillow inward, gathering the intermediate member around the pillow body as shown in FIG. 3. The user then positions his arm or leg over the pillow, restraining it from rolling away from his body. Here again, the desired at least three contact points are maintained with respect to the user.

To facilitate a rolling displacement of the second pillow toward the first pillow, the intermediate member is formed of a flexible material and the first and second pillows are cylindrical in cross-section as illustrated in the drawings. This enables the first and second pillows to be rolled onto the intermediate member when in use by the individual to temporarily and adjustably reduce the length of the full transverse span. This procedure can be applied to realize opposing limiting positions where one of the first or second pillows is rolled and displaced between (i) a distended position with the intermediate member extended to the full transverse span length as shown in FIG. 2 and (ii) retracted positions with the second pillow in closer proximity to the front side of the individual's trunk, illustrated in FIGS. 3-8, with FIG. 3 representing the fully retracted position of the second pillow contacting the abdomen of the individual.

The present pillow combination provides versatility because the user is in selective control of many such position variations. As mentioned above, by rolling the intermediate member onto one of the pillows, the user can push in opposing directions (front and back) and thereby stabilize his side sleeping position. By rolling the intermediate member onto the second pillow, the user can also adjust the separation distance between the pillows, yet still apply opposing forces toward both pillows, restrained from displacement by the selected length of the intermediate member. This ability to maintain a confining force in both the forward and backward orientations is valuable in realizing the stable sleep position on the user's side. The present invention enables the user to make these adjustments without getting out of bed and making extreme position changes. Consequently, a somewhat normal sleep pattern can be established which eventually can be managed by the subconscious mind during the sleeping period.

Again, an object of this invention is to enable mobility to the user while preserving sufficient restraint to stabilize sleep at the side position. If too much restraint exists, particularly as in prior art devices that hold the user in a fixed position, sleep can be frustrated and the user will discard use of the device. On the other hand, if the sleep assist device is merely passive and lacks dynamic adjustment, the user will likely not get sufficient support to restrain himself against a pillow. Once he moves free of the pillow, he will be free to roll onto his back and be subject to the sleep issues he is trying to prevent.

Because of the variable length of the intermediate member, a number of intermediate positions can be selected by the user to provide additional variations in sleep positioning. These will be selected by the user during the natural sleep process, based on what is most comfortable to the specific individual. The ability of the user to make these adjustments without significant effort facilitates compatible use of the pillow combination without the need for full awakening. In time, the user is able to shift positions utilizing the pillow device without having to slip out of his unconscious state. Such movement becomes natural in a manner similar to sleep movement without such a restraining device. These positions involve various orientations of the legs and arms during the side sleeping period, using one pillow against the user's back and the other pillow in contact at the forward side, positioned to stabilize the user with the opposing pillow captured on his back side. In each of these positions, the user is able to sense some confining force at both the front arms, legs or torso and the back side of his body. Sensing these restraining forces inhibits the person from shifting to sleeping on his back.

The number of actual position options will vary with the individual. Not only is there a continuum of length variations to the intermediate member between the two extreme positions, but there are varieties of arm and leg configurations that can be adapted to the device and method. Some of these are illustrated in the following representations.

Figure 4:
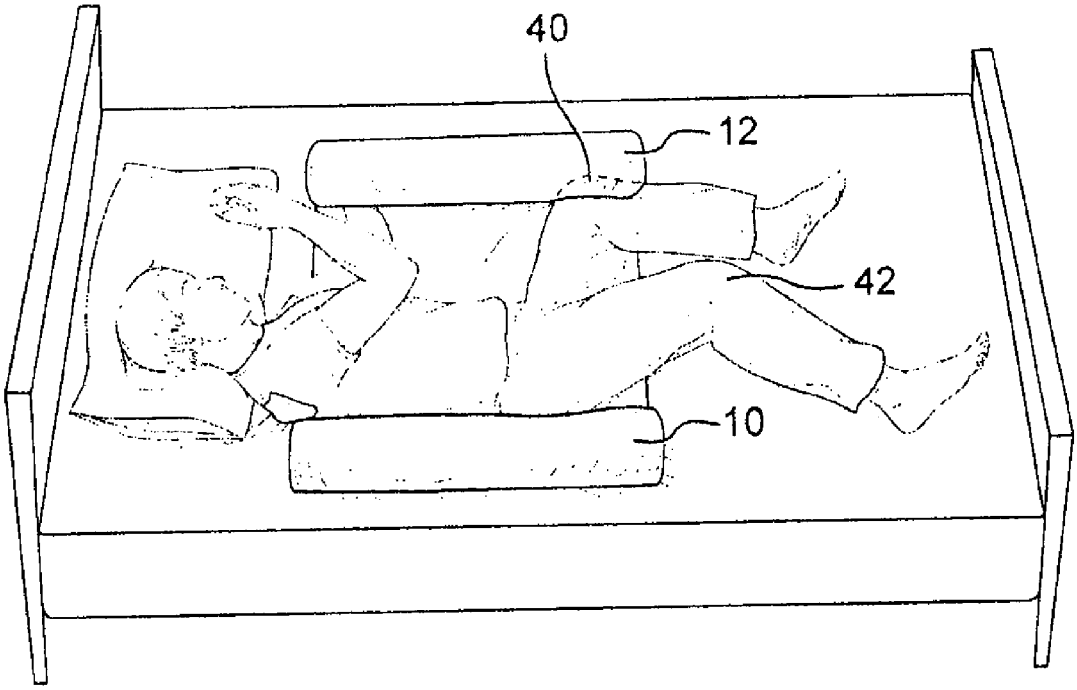
FIG. 4 demonstrates an additional sleeping position with the knee engaging the fully extended pillow.

FIG. 4 shows capturing the second pillow at the fully distended position with one knee 40 of the individual extending in restrained contact with the second pillow to bias the second pillow at the distended position with the individual lying on one side, a remaining knee 42 and leg of the individual being extended downward. In this position, the user is captured on his side, supported at his back with the first pillow 10, with his left knee 40 pushing gently against the second pillow 12. Such a configuration inhibits the body from freely rolling over to the back side.

FIG. 5 is a slight adjustment for the sleeper and illustrates the specific step of capturing the second pillow at the fully distended position with both knees 40 and 42 of the individual extending in direct, restrained contact with the second pillow to bias the second pillow at the distended position with the individual lying on one side. In this instance, the forward force arises from the restraint applied to the second pillow by opposing knees. This represents only slight movement for the user, but a significant restful position.

FIG. 6 illustrates the second pillow at a partially distended position within the range between the distended position and the retracted position, with one leg 44 of the user draped over the second pillow. Movement of the legs is a natural component of healthy sleep. This position can be easily implemented by rolling the second pillow toward the user, shortening the length of the intermediate member. This action maintains the intermediate member in tension, enabling the weight of the right leg 44 to apply positioning force to the second pillow. Here again, the body feels stabilized to a side sleeping position, but in a comfortable new configuration.

FIGS. 4 and 6 together illustrate the adaptability of the present invention to multiple positions wherein the individual freedom of movement includes adjusting orientation of a lower limb (i) from an acute angle when in a partial knee extension forward of the trunk, with the second pillow in a retracted contact configuration, (ii) to a full knee contact extension with the second pillow and with the limb at approximate right angles with the trunk, the second pillow being positioned at the full transverse span.

A further adaptation is shown in FIG. 7 with the second pillow 14*a* rolled fully against the front side of the individual, thereby capturing the individual between the first and second pillows with the individual lying on a side. This is perhaps the most secure configuration for the pillows because the body is trapped on its side. Because of this restraint, it may be the least comfortable over an extended period of time. In this case, the opposing pillows are applying direct opposing forces on the front and back of the user. An advantage of the present pillow combination is the ease of adjusting the second pillow to a new configuration in which both the arms and legs of the user are free to move by simply rolling the second pillow to one of numerous locations between the two extremes of separation distance.

This freedom of movement also includes the ability to rotate the body to opposite side between right and left side body contact with the bed. It should also be understood that reference to the "first" pillow at a back side of the individual could refer to either pillow of the pillow combination, depending upon whether the individual is on his right or left side. An advantage of the present invention, for example, is that the user can rotate his body 180 degrees so that the back side of his trunk is now positioned against the second pillow, reversing all of the forward orientations now to the other direction. Therefore, the references to first and second pillow should be understood to include this reversible interpretation, with the first pillow being that pillow which is positioned at the individual's back and the second pillow having the forward location from his trunk.

FIG. 8 illustrates positioning the second pillow at a partially distended or retracted position 10 and capturing the second pillow between the knees of the individual. This is a variation of FIG. 5, but with the intermediate member shortened, drawing the second pillow further toward the abdomen of the user. As mentioned above, this adjustment is enabled by selecting flexible material for the intermediate member which permits retracting the second pillow to a closer position to the first pillow from the full transverse span.

It will be apparent to those skilled in the art that numerous other positions will be possible without departing from the principles suggested by the above illustrations. For example, the method for developing a positional orientation sleep aspect as defined as defined herein may further include the step of positioning the individual's body in the preselected side-position orientation on the intermediate member and establishing at least a fourth separate and concurrent point of contact to include a fourth contact as part of the POSA at a forward projecting, second limb of either an arm or leg of the individual's body with the second pillow. This is illustrated in FIGS. 2, 4, 5, 6 and 8, wherein both the arms and legs of the user are contacting the second pillow, providing at least four or five total contact points within the individual's frame of reference.

Figure 14:
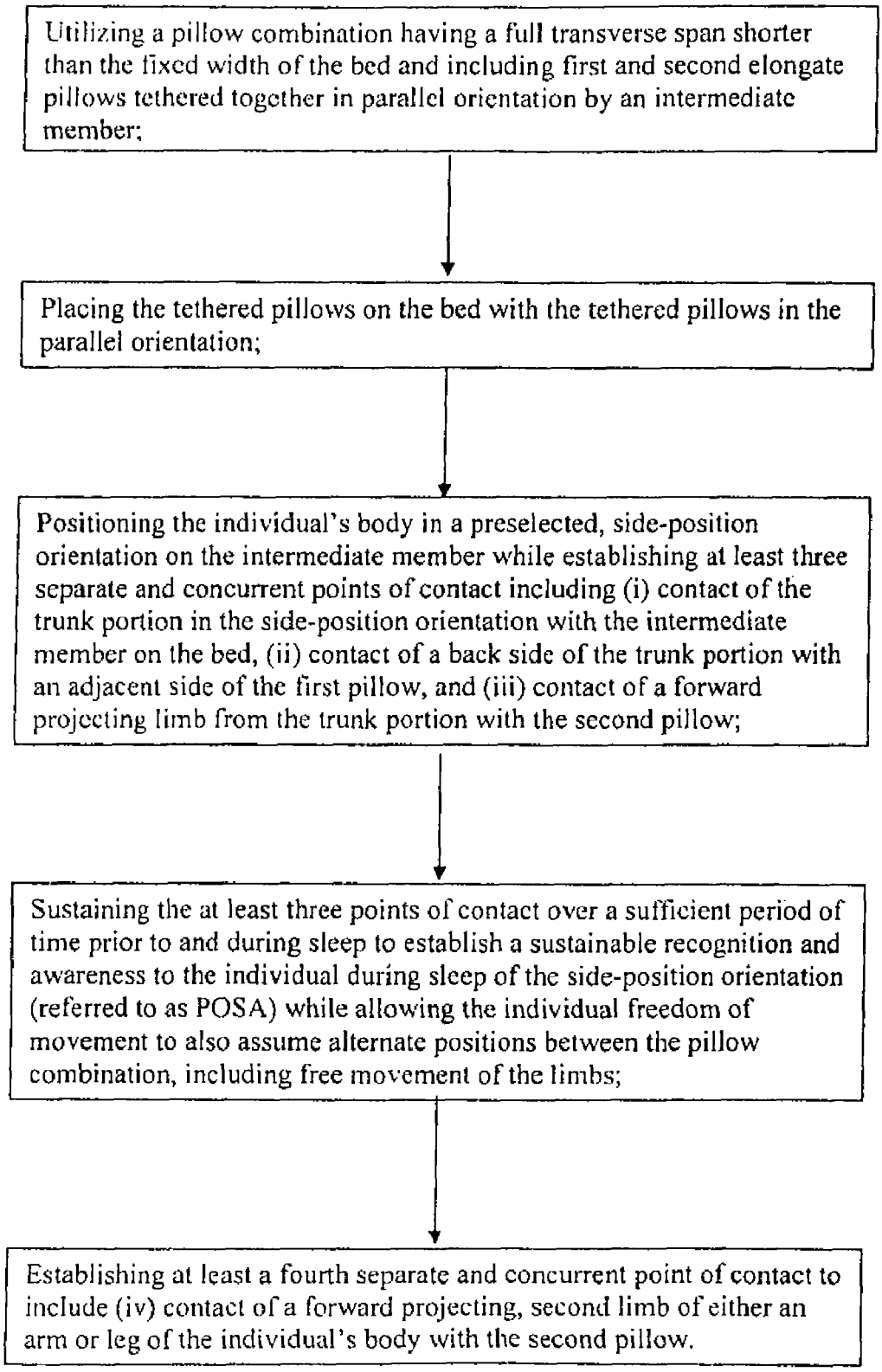
FIG. 14 illustrates one method of practicing the present invention.
Figure 15:
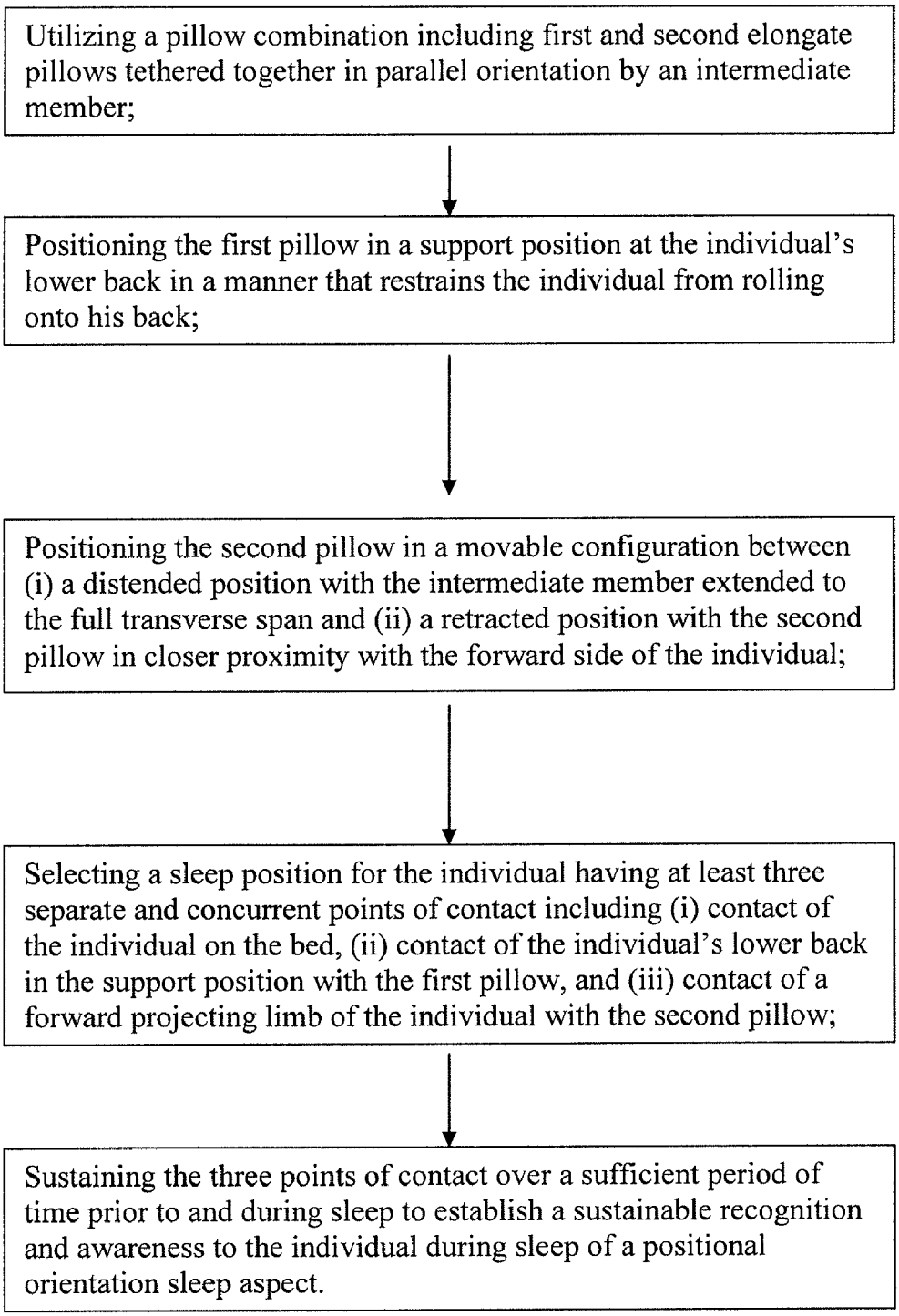
FIG. 15 sets forth an additional embodiment of the method for practicing the invention.

The preceding discussion of the various methods of invention are specifically represented in FIGS. 14 and 15.

These methods of restraint are facilitated by a pillow combination device for assisting an individual user to maintain a side sleeping position on either a left or right side. As mentioned above, this device can be formed in several configurations using different materials. For example, FIG. 1 includes first 10 and second 12 elongate pillows attached in substantial parallel relationship at opposing sides of an intermediate member 14 and at a maximum separation distance 16 approximately equal to a length extending from a back portion of hips to a forward portion of knees of the individual. The pillows and intermediate member are moveable to a variety of fixed separation distances selectable by a user between (i) a fully distended position with the first pillow configured for capture at the lower back and hips of the user, the intermediate member being extended to full length with knees of the user in tension with and contacting the second pillow, and (ii) a fully retracted position with the intermediate member retracted to a fixed, shorter length, the second pillow being configured for maintaining contact at a forward side of the abdomen and hips of the individual.

Continuing with a description of various embodiments of pillow devices, FIG. 9 shows other tubular members 90 and 91 that depict plastic tubes attached to opposing ends of intermediate straps 97, comprising the intermediate member. As with the previous pillow descriptions, the plastic tubes are compressible against the body, but resist collapse so that the trunk of the individual is supported. The primary function of the tube structure is to resist against body movement and prevent the user from rolling over the tube onto his back. Therefore, any tubular structure that is capable of restraining this rolling movement should be useful.

Typical diameters 94 of the tubular shapes (whether fabric pillows or plastic mesh) will be from four inches to 12 inches. Actual selection of tube diameter will depend upon the weight and size of the individual. Smaller persons will find a 3 to 5 inch diameter acceptable. Persons having a large frame may 8 to 12 inch diameter. Persons of medial size (150 to 250 lbs) can likely manage with 4 to 9 inch diameters. Actual sizes will typically be suited specifically to the body's size and weight, including waist circumference. The length of the pillows is variable, and may extend from 12 inches or more, depending upon the individuals height. An average length has been found useful at between 18 to 23 inches.

As previously mentioned, one cause of discomfort for the user may be the accumulation of body heat that causes some sweating, particularly at the low back contact surface on the pillow. The tube mesh configurations of 90 and 91 provide circulation of air through the tube wall, as well as within the tube itself to thereby reduce build up of body heat at the contact points, similar to the inflatable bladders outlined above.

By using a mesh plastic tube capable of providing the desired resistance against body movement, air flow 96 is preserved through the tube and tube wall, minimizing heat build up. Consequently, an advantage of the plastic mesh tube as a replacement for a conventional pillow insert is a reduction of retained body heat at the pillow. This arises from the open passage 92 for air movement through the tubular body. Tether straps 97 can be used as an alternative to the continuous intermediate member 14 as previously discussed. This design also permits one tube member having a slightly shorter diameter to be stored inside the second tube as show with item 98. In this configuration, the system can be easily transported in a suitcase or with other travel arrangements.

Other pillow combinations can be formed by using other manufacturing procedures for developing specific design features. For example, the first and second pillows and the intermediate members may be integrally formed of a continuous sheet of material. The first and second pillows are formed by attaching an outer edge of the continuous material to end sections of the intermediate member to form the respective tubular members with open ends. The respective open lumens for each tubular member are filled with a compressible insert of sufficient bulk stiffness to provide a restraining, support resistance against the respective at least three contact points of the individual's body. This specific design represents an example of an integral construction which needs to be presized to individuals with an appropriate hip to knee span.

Figure 10:
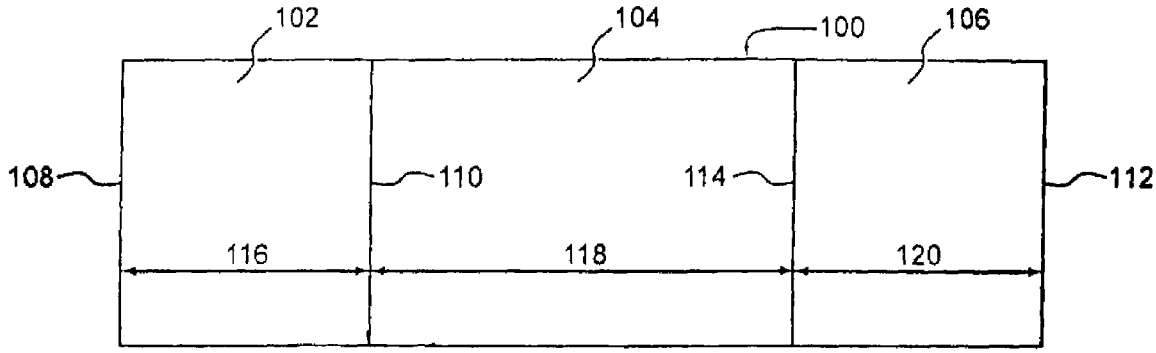
FIG. 10 shows a graphic layout for one embodiment of the pillow system using bed sheet material.

FIG. 10 illustrates such a fabrication technique using bed sheet material. Construction may use a single piece of fabric 100 divided into three sections. At the opposing ends 102 and 106, the material is sized to provide an appropriate diameter to the pillow member. In the circular embodiment illustrated, the mathematical expression of $2\pi r$ gives the circumference. This, therefore, becomes the length of materials allocated at the opposing ends of the full length of material 100. The intermediate section 104 will be the intermediate member 14 formed between the opposing pillows 10 and 12. The device is completed by sewing the opposing extending ends of the material 108 and 112 to the terminal locations of the intermediate member 110 and 114 respectively. These opposing tubular sections formed receive pillow insert material to complete the desired product. For travel convenience, the device can be transported in the flat configuration with the opposing tubes collapsed, and then stuffed at a motel or other location with pillow inserts. Typical lengths 116, 118 and 120 for the respective sections will vary with the size of individuals and the width of the bed, as was previously stated.

As previously noted, the full transverse span of the pillow combination must be less than the fixed width of the bed because both pillows must be fully supported on the bed surface. A greater span would result in at least one of the pillows displacing over the edge of the bed and becoming nonfunctional. For example, a bed of conventional single size mattress will have a fixed width slightly wider than the maximum full transverse span of the pillow combination, using most of the bed surface. A full size, queen or king size bed obviously will be much larger that the span of the pillow combination and will provide ample space to function properly. A queen sized bed, for example, occupied by two persons will likely limit the total width of the pillow device to half the width of the bed, allowing free space for the companion sleeper. Accordingly, some balancing may be required between desired total width of the device and maximum width of bed surface available.

In addition to the preceding descriptions of the pillow combination device, a more general definition of the invention is considered to comprise a device for developing a positional orientation sleep aspect (POSA) to enhance individual awareness of sleeping position to enable the individual located on a bed of fixed width to assume at least one preselected side-sleeping orientation on either a left or right side. The device includes:

a) a pillow combination 11 having a full transverse span 15 extending to a maximum length between fully extended outer edges 93 and 95 (FIG. 9) of first 90 and second 91 pillows, which maximum length is shorter than the fixed width of the bed 17. The first and second elongate pillows are tethered together in parallel orientation by an intermediate member 97 and configured to provide concurrent, juxtaposed support at forward and back sides of the individual disposed there between. The first and second elongate pillows have a separation distance corresponding to a width of the intermediate member 97 which is approximately equal to and no greater than a length extending (i) from a low back portion of hips (ii) to a forward portion of knees of the individual.

The pillow combination is configured for positioning the individual's body in a preselected, side-position orientation on the intermediate member 97 to capture the intermediate member under a trunk portion of the body while establishing at least three separate and concurrent points of contact including (i) contact of the trunk portion in the side-position orientation on the intermediate member, (ii) contact of a back side of the trunk portion of the individual with an adjacent side of the first pillow, and (iii) contact of a forward projecting limb of the individual from the trunk portion with the second pillow, as has been previously described.

Figure 11:
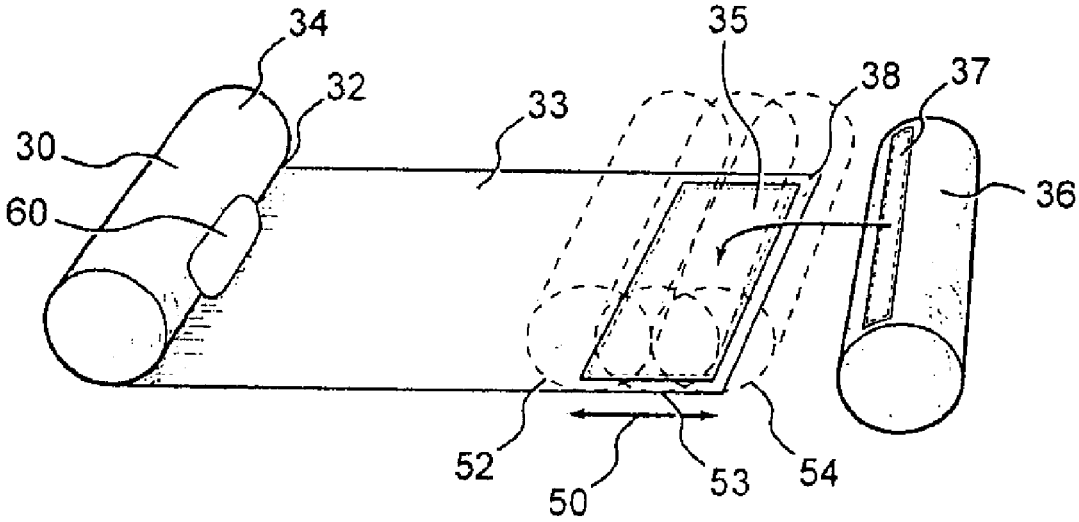
FIG. 11 depicts an additional embodiment of the pillow system with a removable pillow at one side.

From a functional perspective, the first and second pillows comprise deformable cushion members coupled to opposing sides of the intermediate member. The pillows may be integrally or removably coupled at respective sides of the intermediate member. For example, FIG. 11 illustrates a pillow combination 30 with one side 32 of the intermediate member 33 integrally attached or formed as part of the first pillow 34. The second pillow 36 is separately formed and is configured to be removably coupled at an opposing side 38 of the intermediate member. This removable configuration facilitates detachment by the user for easier entry and egress from the pillow combination. Otherwise, the user is typically required to slide over the top of one pillow which is located at the edge of the bed for entry or egress. With the removable pillow, the user simply releases the coupling structure 35 and 37, and displaces the pillow from the intermediate member 33 to a location out of the path of movement.

A further advantage of the detachable pillow is to enable fixation of the second pillow 36 at a plurality of locations 50, such as a proximate 52, an extreme 54 length, or any of variable intermediate lengths 53 for defining the full transverse span of the pillow combination. In this configuration, the separation distance between the respective pillows is adjustable to accommodate the correct length measured from a person's low back side to the knee. In the illustration, mating Velcro® material is used as the attachment structure 35 and 37. The user simply positions himself on the intermediate member 33 with his low back against the first pillow 34 and extends his knees at right angles from his trunk to contact the first pillow. This configuration set the correct length for attachment of the second pillow 36. The Velcro strip 37 is then coupled to its mating structure 35 at this location and the pillow combination is correctly sized for the user.

As a complementary feature of the present invention, the use of an additional back/knee pillow is disclosed. As shown in FIG. 11, a small pillow 60, sized to rest between the user's knees for comfort, provides favorable position of the legs and knees when together. This same pillow 60 can be used at the back side of the individual as shown with respect to the first pillow to shorten the distance between the first and second contact points of back side to full knee contact at an approximate 90 degree orientation. In some instances, the individual may prefer more tension applied to the pillow combination to yield a more snug fit of the body between the first and second pillows. The back/knee pillow can easily be positioned behind the low back of the user, in contact with the first pillow. By displacing the individual closer to the second pillow, the shorter separation distance can be achieved. This can be adjusted by adjusting the effective thickness of the pillow at the low back. The POSA concept is maintained because the first point of contact is still with the first pillow, via the intermediate back/knee pillow 60.

Compositions for the back/knee pillow can include foam, flowable gel, flowable beads, conventional down or pillow insert material, or any other material capable of resisting pressure from the user's back, in combination with support from the first pillow. By making the pillow in an elongate configuration, it can be folded onto itself to provide an adjustable thickness. An exemplary method of use would include the steps of positioning the body with the three points of contact as previously described, and then placing the back/knee pillow between the back side of the user and the first pillow, thereby displacing the individual more proximate to the second pillow. Using his knees, the individual can then adjust the amount of pressure or tension felt between his body and the first and second pillows by adjusting the angle of incidence between the knees and the second pillow.

Also disclosed herein is a supplemental device 130 to further assist a person during a training or programming period, providing an alarm to alert the user of a supine position during sleep. Such alarm may be of any suitable type—audible, vibrating, etc. This device comprises a small sensor attachable to the body and capable of sensing when the user is lying on his back in a supine sleep position. This device may be fixed on a belt or bed clothing and can be selected from any of a number of sensors that can register the adverse sleeping position. One example of such a device is a gravity-responsive sensor such as a mercury tube with opposing electrical contacts and oriented in perpendicular orientation to the spine such that it will trigger an alarm when a horizontal position occurs corresponding to the user lying on his back, resulting in the mercury closing the circuit between the contacts. When in the side position, the mercury flows to one end of the tube, opening the electrical circuit and placing the sensor in an inactive mode.

An alternative device could be a pressure transducer 130 that activates an alarm device if the user assumes a sleeping position on his back, thereby applying pressure to the transducer and alerting the user to roll onto his side. Numerous other sensors can be envisioned for this device for effective monitoring of the sleep position. The sensor can be coupled to a vibrator or audio alarm that notifies the user to turn onto his side for appropriate correction. This device may be used with the pillow system discussed above, or even independently for users that are not comfortable with use of the pillow system.

Figure 12:
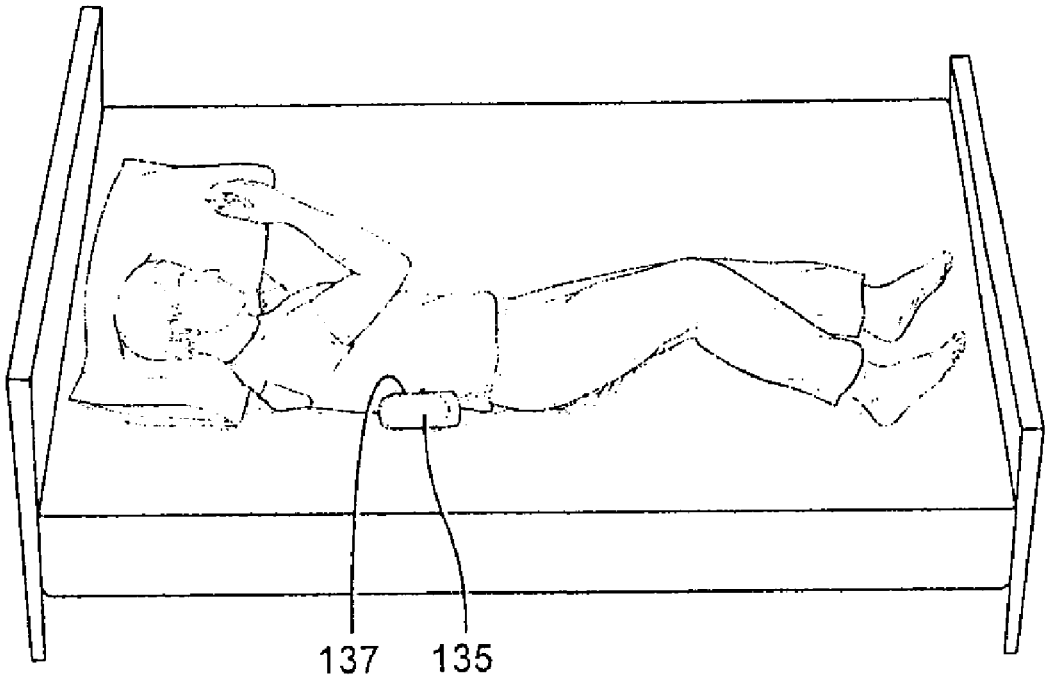
FIG. 12 illustrates an alternate method and device for biasing a person against sleeping in a supine position using a back pillow.

As an alternate temporary sleep aid for encouraging a user to avoid sleeping in supine orientation, FIG. 12 illustrates an individual in a side-sleeping configuration which is encouraged by use of an elongate pillow member 135. The pillow member is positioned at the user's back and is oriented along the spine, typically between the shoulders and the low back. The pillow member may be removably or integrally fixed to the back of bed clothing or a shirt so that the desired back location of the pillow is automatically positioned by robing in the clothing. For the removable configuration, fastening means such as Velcro can be used, permitting the washing of the pillow and clothing separately.

Figure 13:
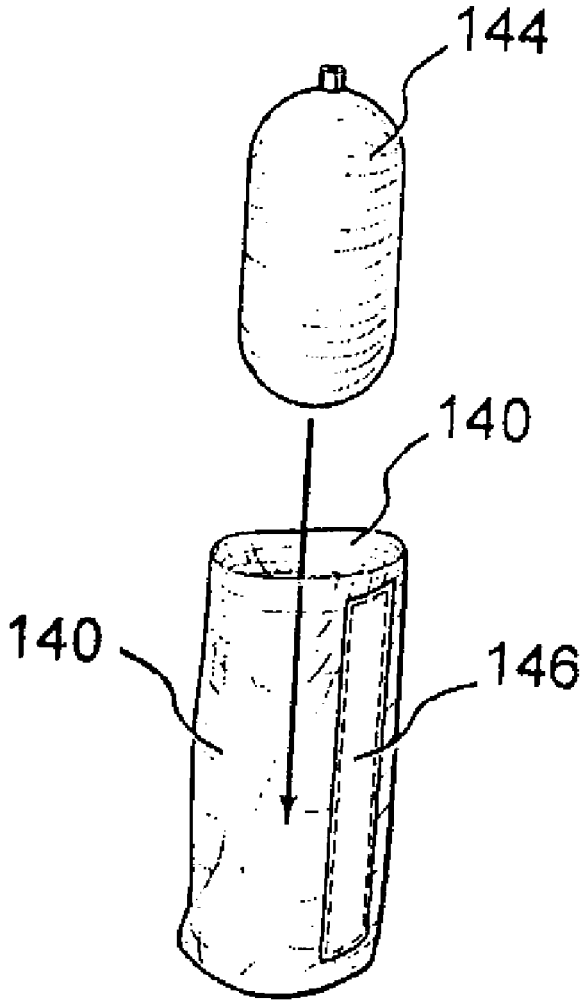
FIG. 13 depicts an additional embodiment of the back pillow.

FIG. 13 illustrates a pillow member comprising a sleeve component 140 configured in a cylindrical shape with an open end 142 for receiving an insert pillow 144 within the cylinder. The pillow is preferably an inflatable pillow shaped as a hotdog or similar configuration; however, other suitable filler materials could be used as with the pillow combination described above. This elongate configuration disperses the forces applied at the user's back to avoid undue stress on the spine or back. The elongate shape also facilitates proper orientation of the device along the back in substantial parallel orientation with the spine. In this manner, the full surface along one edge of the pillow member 140 is contacted at the bed surface, thereby dispersing the contact forces across the back, rather than at a single point on the back, as occurs with the tennis ball methodology of current practice. The sleeve member can be made of sheet material and include a removable Velcro attachment component as described above.

Typical dimensions for the pillow member 135, 140 are cross-sectional widths of about 3 to 6 inches for an average sized person, and a length of 3 to 12 inches. A preferred range of 4 to 6 inches in length provides a very light weight device that can hardly be noticed when suspended on the user's back. In contrast to the tennis ball or other hard object, the pillow member's contact with the back is spread over a large area, minimizing any discomfort from its inherent weight on the person. In typical use, the individual hardly is aware of its presence. If, however, the person attempts to roll onto his back, the pillow member limits the rotation by blocking a supine position. Under the compressive weight of the individual, the dispersion of forces is even more significant, spreading the weight of the individual when lying on the pillow member to a large area. Ideally, by sizing the pillow member with a sufficient diameter and stiffness, the individual is unable to roll into the supine orientation and will tend to gravitate back to the side-sleeping position.

In addition to the various devices and methods discussed above, the medical community has developed other implements useful in assisting with productive sleep. One such device is the CPAP instrument for applying positive air pressure to the lungs. The present POSA system is also well adapted for use with CPAP devices as well as in place thereof where the individual is unable to adapt to the face mask or high pressure interface of the CPAP device. Specifically, because the POSA system reduces the likelihood of breathing interruption by sleep apnea, a doctor may approve a reduction in the CPAP pressure values when used with POSA to more comfortable values that merely assist flow of oxygen to the user. This can be particularly helpful to patients suffering from partially obstructed breathing such as with allergy and sinusitis patients that have sinus problems and/or highly restricted nasal passages. Where appropriate, the user can actually use a very low pressure CPAP device to feed air/oxygen directly to a mouth piece suitable for allowing the individual to breathe directly through his mouth. The CPAP device can be adapted with humidity and temperature controls to simulate the moisture and warmth provided to inspired air by the nasal cavities, thereby avoiding the blocked sinuses. A suitable mouth piece can include a pliable rubber member adapted to be held between the teeth in a partially closed position of the jaw. The primary function of this air delivery system is to supply warm, humid air to the individual so that mucosal tissue within the mouth is not dried or irritated by air flow during sleep. Conventional connecting tubing and CPAP methodologies can be modified to meet this need.

An additional application of the present invention includes use of the CPAP in combination with POSA to allow segmented and alternating periods of sleep for several hours with and without CPAP support. The side-sleeping orientation facilitates improved breathing in both procedures and thereby provides periods of relief from the CPAP support. The POSA system also enables persons with snoring problems to remain in a side-sleeping position, thereby minimizing occurrence of snoring. Other benefits of POSA as part of a side-sleeping protocol will be recognized by those skilled in the art.

As part of this POSA system, the individual can use support straps that position the CPAP face mask or nose pillow to attach an eye mask to block out unwanted light for extending a nocturnal environment during daylight hours. For example, a conventional eye mask can be mounted with removable clips at each side, to attach at corresponding support bands or straps (located at the side of the user's head) of the CPAP mask. This configuration allows the CPAP mask to provide the support structure to the eye mast over the eyes. As light becomes a problem for the individual, he simply clips the eye mask in place by attaching straps from each side of the eye mask to corresponding sides of the CPAP support straps and adjusts the mask to appropriately cover his eyes. In addition to the convenience of this arrangement, the mounting with the CPAP face mask permits a significant reduction in mask tension over the eye because the straps of the CPAP are able to correctly position and retain the eye mask in place.

Other sleep assist methods, structural features and combinations thereof will become apparent to one of ordinary skill in the art, based on the foregoing examples. Accordingly, the present invention is to be construed by the following claims, and is not to be limited to specific examples provided above.

We claim:

1. A method for developing a positional orientation sleep aspect (POSA) to enhance individual awareness of sleeping position to enable the individual located on a bed of fixed width to assume at least one preselected side-sleeping orientation alternately on either a left or right side, said method utilizing a pillow combination having a full transverse span shorter than the fixed width of the bed and including first and second cylindrically configured, elongate pillows tethered together in parallel orientation by an intermediate member for providing concurrent lateral restraint at forward and back sides of the individual, said method comprising steps of:

a) placing the cylindrically configured, tethered pillows on the bed with the tethered pillows in the parallel orientation;

b) positioning the individual's body in a preselected, side-position orientation on the intermediate member to capture the intermediate member under a trunk portion of the body while establishing at least three separate and concurrent points of contact including (i) contact of the trunk portion in the side-position orientation with the intermediate member on the bed, (ii) contact of a low back side of the trunk portion with an adjacent side of the first pillow, and (iii) contact of a forward projecting leg from the trunk portion with the second pillow;

c) sustaining the at least three points of contact over a sufficient period of time prior to and during sleep to establish a sustainable recognition and awareness to the individual during sleep of the side-position orientation (referred to as POSA) while allowing the individual freedom of movement to also assume alternate positions between the pillow combination, including free movement of the individual's limbs.

2. A method for developing a positional orientation sleep aspect as defined in claim 1, further comprising the step of positioning the individual's body in the preselected side-position orientation on the intermediate member wherein the at least three separate and concurrent points of contact include (i) the contact of the trunk portion in the side-position orientation with the intermediate member on the bed, (ii) low back contact of the individual's body with the adjacent side of the first pillow, and (iii) extended knee contact of the individual's body with the second pillow.

3. A method for developing a positional orientation sleep aspect as defined in claim 1, further comprising the step of positioning the individual's body in the preselected side-position orientation on the intermediate member wherein the at least three separate and concurrent points of contact include (i) the contact of the trunk portion in the side-position orientation with the intermediate member on the bed, (ii) low back contact of the individual's body with the adjacent side of the first pillow, and (iii) extended leg contact of the individual's body over the second pillow with the second pillow in a partially retracted position toward the first pillow.

4. A method for developing a positional orientation sleep aspect as defined in claim 1, further comprising the step of positioning the individual's body in the preselected side-position orientation on the intermediate member and establishing at least a fourth separate and concurrent point of contact to include (iv) contact of a forward projecting, second limb of either an arm or leg of the individual's body with the second pillow.

5. A method for developing a positional orientation sleep aspect as defined in claim 1, further comprising the step of configuring the pillow combination with a separation distance between the first and second pillows which is approximately equal to a distance extending from the low back of the individual's body to knees of the individual.

6. A method for developing a positional orientation sleep aspect as defined in claim 1, further comprising the steps of (i) selecting flexible material for the intermediate member which permits retracting the second pillow to a closer position to the first pillow from the full transverse span and (ii) adjusting the preselected, side-position orientation to a second, side-position orientation.

7. A method for developing a positional orientation sleep aspect as defined in claim 1, wherein the individual freedom of movement includes adjusting orientation of a lower limb (i) from an acute angle when in a partial knee extension forward of the trunk, with the second pillow in a retracted contact configuration, (ii) to a full knee contact extension with the second pillow and with the knee and leg at approximate right angles with the trunk, the second pillow being positioned at the full transverse span.

8. A method as defined in claim 1, further comprising:

a) configuring the pillow combination with a full transverse span extending to a maximum length between fully extended outer edges of the first and second pillows, which maximum length is shorter than the fixed width of the bed, and configured to provide concurrent, juxtaposed lateral support at forward and back sides of the individual disposed there between, and b) positioning said first and second elongate pillows at a separation distance corresponding to a width of the intermediate member which is approximately equal to and no greater than a length extending (i) from a low back portion of hips (ii) to a forward portion of knees of the individual.

9. A method as defined in claim 1, further comprising the step of inflating the first and second pillows with inflatable bladders.

10. A method as defined in claim 1, further comprising the step of removably coupling the second pillow to an opposing side of the intermediate member.

11. A method as defined in claim 10, comprising the step of attaching the removable second pillow at one of a plurality of attachment positions disposed at different transverse positions along an adjacent outer margin of the intermediate member to enable fixation of the second pillow at a plurality of positions for defining multiple lengths for the full transverse span, thereby providing for adjustment of the full transverse span to different lengths for persons of differing sizes.

12. A method as defined in claim 1, comprising the method of forming the first and second pillows and the intermediate members of a continuous sheet of material, the first and second pillows comprising integral extensions of end sections of the intermediate member configured as tubular members having open lumens for insertion of a compressible insert of sufficient stiffness to provide a restraining, support resistance against the two side contacts of the at least three contact points of the individual's body.

13. A method as defined in claim 1, comprising the step of rolling one of the cylindrically shaped first and second pillows onto the intermediate member when in use by the individual to temporarily and adjustably reduce the length of the full transverse span when one of the first or second pillows is rolled and displaced between (i) a distended position with the intermediate member extended to the full transverse span and (ii) a retracted position with the second pillow in closer proximity to the front side of the individual's trunk.

14. A method for assisting an individual to maintain at least one preselected side-sleeping orientation on either a left or right side on a bed of fixed width, said method utilizing a pillow combination having a full transverse span between respective outer side edges of the pillow combination which is shorter in length than the fixed width of the bed and including first and second cylindrically configured, elongate pillows tethered together in parallel orientation by an intermediate member for providing concurrent support at forward and back sides of the individual, said method comprising steps of:

a) placing the pillow combination on the bed;

b) positioning the individual on the intermediate member to capture the intermediate member under the individual with the individual's hips and lower back positioned between the first and second cylindrically configured pillows;

c) positioning the first pillow in a support position at, but not under, the individual's lower back in a manner that restrains the individual from rolling onto his back;

d) positioning the second pillow in a movable configuration between (i) a distended position with the intermediate member extended to the full transverse span and (ii) a retracted position with the second pillow in closer proximity with the forward side of the individual;

e) selecting a sleep position for the individual having at least three separate and concurrent points of contact including (i) contact of the individual in the side-position orientation with the intermediate member on the bed, (ii) contact of the individual's lower back in the support position with the first pillow, and (iii) contact of a forward projecting limb of the individual with the second pillow;

f) sustaining the three points of contact over a sufficient period of time prior to and during sleep to establish a sustainable recognition and awareness to the individual during sleep of a positional orientation sleep aspect representing the side-position orientation while allowing the individual freedom of movement to also assume alternate positions between the pillow combination, including free movement of the limbs.

15. A method as defined in claim 14, wherein step e) comprises the more specific step of capturing the second pillow at the fully distended position with one knee of the individual extending in restraining contact with the second pillow to bias the second pillow at the distended position with the individual lying on one side, a remaining knee and leg of the individual being extended downward in an unrestrained position.

16. A method as defined in claim 14, wherein step e) comprises the more specific step of capturing the second pillow at the fully distended position with both knees of the individual extending in direct, restraining contact with the second pillow to bias the second pillow at the distended position with the individual lying on one side.

17. A method as defined in claim 14, wherein step e) comprises the more specific step of positioning the second pillow at a partially distended position within the range between the distended position and the retracted position.

18. A method as defined in claim 17, further positioning the second pillow at the partially distended position and comprising the further step of repositioning the second pillow against a front side of the individual's trunk, thereby capturing the individual between the first and second pillows with the individual lying on a side.

19. A method as defined in claim 14, wherein step e) comprises the more specific step of capturing the second pillow at the partially distended position by starting with the intermediate member in the fully distended position, and then rolling a free portion of the intermediate member around the second pillow and towards the individual, thereby reducing the length of the full transverse span of the pillow combination.

20. A method as defined in claim 14, further including the steps of:

a) positioning the body with the three points of contact as previously described;

b) placing a smaller, back/knee pillow between the back side of the individual and the first pillow, thereby displacing the individual more proximate to the second pillow; and c) adjusting position of the individual's body with respect to the first and second pillows by adjusting an angle of contact of knees of the individual with the second pillow.

* * * * *